United States Patent [19]

Mori

[11] Patent Number: 5,055,011

[45] Date of Patent: Oct. 8, 1991

[54] ELECTROMAGNETIC TYPE RECIPROCATING PUMP

[75] Inventor: Tamotsu Mori, Tokyo, Japan

[73] Assignee: Man Design Co., Ltd., Tokyo, Japan

[21] Appl. No.: 530,425

[22] Filed: May 31, 1990

Related U.S. Application Data

[63] Continuation of Ser. No. 332,043, Apr. 3, 1989, abandoned.

[30] Foreign Application Priority Data

Apr. 6, 1988 [JP] Japan ..... 63-45750

[51] Int. Cl.[5] ..... F04B 35/04

[52] U.S. Cl. ..... 417/417

[58] Field of Search ..... 417/417, 416, 311; 92/130 D, 135

[56] References Cited

U.S. PATENT DOCUMENTS

| | | | |
|---|---|---|---|
| 2,806,432 | 9/1957 | Brooks | 417/417 |
| 3,514,228 | 5/1970 | Toyoda . | |
| 3,804,558 | 4/1974 | Naito . | |
| 4,021,152 | 5/1977 | Toyoda | 417/417 |
| 4,080,552 | 3/1978 | Brown | 417/417 |
| 4,101,950 | 7/1978 | Hager et al. | 417/417 |
| 4,252,505 | 2/1981 | Toyoda . | |
| 4,352,645 | 10/1982 | Meyer . | |
| 4,838,771 | 6/1989 | Kikuchi | 417/417 |

*Primary Examiner*—Richard A. Bertsch
*Assistant Examiner*—David W. Scheuermann
*Attorney, Agent, or Firm*—Nixon & Vanderhye

[57] ABSTRACT

An electromagnetic type reciprocating pump comprises an electromagnet whose magnetization and demagnetization are repeated by a half wave-rectified version of alternating current or direct current in the form of pulses, a piston having a magnetic member which is attracted by the magnetization of the electromagnet, a cylinder in which the piston is inserted and guided, a first urging member for imparting a reaction force in a backward direction to the piston which is moved in a forward direction and a second urging member for imparting a reaction force, which is weaker than that of the first urging member, to the piston in the forward direction.

1 Claim, 1 Drawing Sheet

ELECTROMAGNETIC TYPE RECIPROCATING PUMP

This is a continuation of application Ser. No. 07/332/043, filed Apr. 3, 1989, now abandoned.

BACKGROUND OF THE INVENTION

1. Field of the Invention

The present invention relates to an improved electromagnetic type reciprocating pump which is utilized for a compressor, vaccum pump and so on.

2. Description of the Related Art

A conventional electromagnetic type reciprocating pump comprises, as shown in FIG. 2, an electromagnet 100 having a coil 100*a* and core 100*b* and a piston 101 having a magnetic member 101*a* at one end portion. The coil 100*a* is connected to an AC power supply 103 via a rectifier (a diode) 102. The other end portion of the piston 101 is inserted into a cylinder 104 and urged by a coil spring 105 toward a cylinder head 104*a*. A suction valve 106 and exhaust valve 107 are provided at the cylinder head 104*a*.

In the aforementioned electromagnetic type reciprocating pump, the magnetization and demagnetization of the electromagnet 100 are repeatedly performed by a half wave-rectified pulse of alternating current. In the magnetization mode, the magnetic member 101*a* of the piston 101 is attracted, causing the piston 101 to move in a forward direction under a compression force to suck a fluid into the cylinder 104 via the suction valve 106. In the demagnetization mode, the piston 101 is moved, in a backward direction, under a reaction force of the coil spring 105, causing the fluid present within the cylinder 104 to be exhausted via the exhaust valve 107.

In the aforementioned electromagnetic type reciprocating pump, when the piston 101 is moved backward with the demagnetization of the electromagnet 100, the fluid i.e., gas, which is compressed within the cylinder 104 acts as a cushion. In a conventional fluid pump, when an input voltage to be applied to the electromagnet 100 is lowered, for some reason or other, at a time of starting for example, an amount of returning of the piston 101 becomes smaller due to a corresponding magnetic attraction force and an amount of fluid sucked becomes smaller, thus failing to obtain an adequate cushion action when the piston 101 is moved in a backward direction. As a result, the piston 101 hits against the cylinder head 104*a* to produce a pounding sound also known as piston shock. In a conventional general-purpose fluid pump, when the input voltage to be applied to the electromagnet is lowered so as to control a fluid pressure or amount, the aforementioned adverse situation is encountered. It is, therefore, necessary that a pressure regulator be mounted on the pump so as to regulate a cushion action.

SUMMARY OF THE INVENTION

It is accordingly the object of the present invention to provide an electromagnetic type reciprocating pump which never generates a pounding sound of a piston when an input voltage to be applied to the electromagnet is lowered.

The object of the present invention is achieved by an electromagnetic type reciprocating pump comprising:

an electromagnet whose magnetization and demagnetization are repeated by a half wave-rectified version of alternating current or direct current in the form of pulses;

a piston having a magnetic member which is attracted by the magnetization of the electromagnet;

a cylinder in which the piston is inserted and guided along it;

first urging means for imparting a reaction force in a backward direction to the piston which is moved in a forward direction under a magnetic force of the electromagnet; and second urging means for imparting a reaction force which is weaker than that of the first urging means to the piston.

In the magnetic type reciprocating pump of the present invention, upon the magnetization of the electromagnet an elastic force of the second elastic body is imparted to the piston which is moved in a forward direction in such a manner that the first elastic body is compressed under a magnetic force of the electromagnet. When this is done, the forward movement of the piston is promoted, sucking a fluid into the cylinder. In the demagnetization of the electromagnet, the piston is moved in the backward direction under a reaction force of the first elastic body to allow the fluid within the cylinder to be exhausted. Even if at this time the fluid which is initially sucked is not adequate to obtain a cushion action, the second elastic body which is compressed with the backward movement of the piston acts as a cushion, thereby preventing an impact of the piston upon the cylinder head.

The electromagnetic type reciprocating pump according to the present invention can be driven even if an input voltage is lowered. A low-pressure rating operation can be performed without the generation of, for example, a pounding sound due to an impact of the piston upon the cylinder head. Without using, for example, a pressure regulator, a fluid pressure or amount on the exhaust side can arbitrarily be controlled by phase-controlling the vibration of the piston. It is thus possible to improve a pump performance at low cost.

DETAILED DESCRIPTION OF THE PREFERRED EMBODIMENT

An electromagnetic type reciprocating pump according to an embodiment of the present invention will be explained below in more detail.

Figure 1:
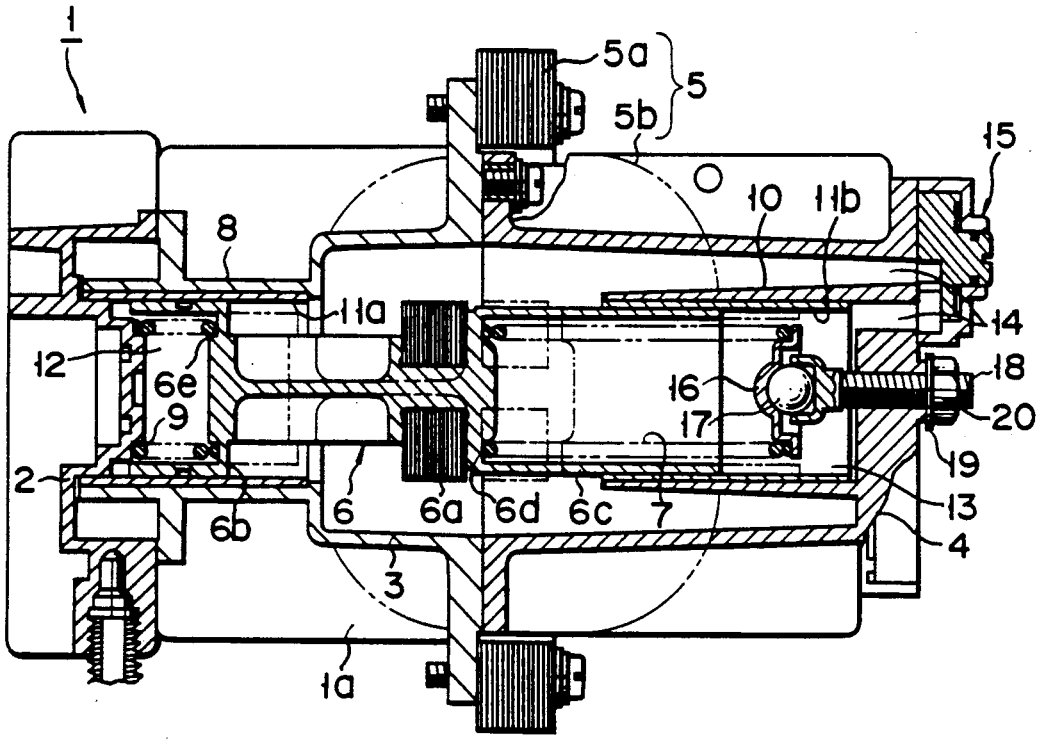
FIG. 1 is a vertical cross-sectional view showing an electromagnetic type reciprocating pump.
Figure 2:
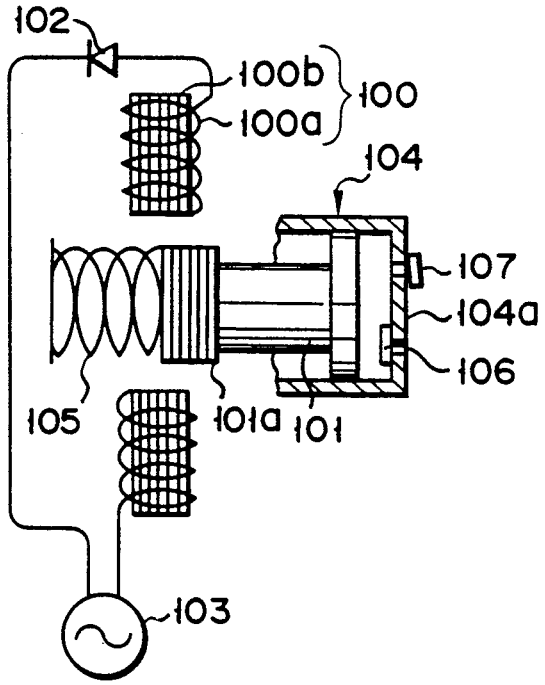
F I G. 2 (PRIOR ART)
FIG. 2 is a schematic view showing a general conventional electromagnetic type reciprocating pump.

FIG. 1 shows an electromagnetic type reciprocating pump according to the embodiment of the present invention. The electromagnetic type reciprocating pump 1 comprises a housing 1*a* having a front cover 2, front casing 3 and rear casing 4; an electromagnet 5 for repeating magnetization and demagnetization by every cycle of alternating current, DC pulses, etc; a piston 6 having a magnetic member 6*a* which is attracted by the magnetization of the electromagnet 5; a first compression coil spring, that is, a first urging member, which imparts an elastic force to a piston 6 which has been moved in the forward direction under the magnetic action of the electromagnet, and hence moves it in the backward direction, that is, to the left in FIG. 1; a cylinder (front cylinder 8) for guiding the piston 6 in the reciprocating fashion; and a second compression coil spring, that is, a second compression spring, which has a smaller spring coefficient than that of the first compression coil spring and imparts a smaller elastic force than that of the first compression coil spring to the piston 6.

The electromagnet 5 has an iron core 5*a* and coil 5*b* indicated by the phantom line in FIG. 1 and is located at a joint location between the front casing 3 and the rear casing 4. The front casing 3 is formed integral with the front cylinder 8 and the rear casing 4 is arranged coaxial with the front cylinder 8 and integral with the rear cylinder 10. Cylinder liners 11*a* and 11*b* are attached to the cylinders 8 and 10, respectively.

The piston 6 has a front piston 6*b* at a front (to the left in FIG. 1) of the magnet member 6*a* and a rear piston 6*c* at a rear (to the right in FIG. 1) of the magnetic member 6*a*. The pistons 6*b* and 6*c* are inserted into the cylinders 8 and 10, respectively. A closed fluid operation chamber 12 is defined by the front cylinder 8, front piston 6*b* and front cover (cylinder head) 2 within the front casing 3 to allow the capacity of the fluid operation chamber 12 to be increased or decreased with a reciprocating motion of the piston 6. A closed spacing 13 is defined between the rear cylinder 10 and the rear piston 6*c* within the rear casing 4 to allow its capacity to be increased and decreased with the reciprocating operation of the piston 6.

In the embodiment of the present invention, an air passage 14 is defined in the rear casing 4, connecting the closed spacing 13 to an outside. A valve mechanism 15 is provided for opening and closing the air passage 14 and the opening and closing states of the air passage 14 are varied in accordance with the frequency of a commercial power source which is different from district to district. By so doing, it is possible to obtain a maximum amplitude (resonance state) of the piston 6 in each district.

The first urging member 7 is supported at one end by a blocked end 6*d* within the rear piston 6*c* and at the other end by a spring seat 16. The spring seat 16 is supported by an adjusting screw 18 through a ball 17 so as to adjust a compression force of the first urging member 7. The adjustment screw 18 is fixed by a locking nut 20 to the rear casing 4 with a washer 19 placed therebetween. The second urging member 9 is located opposite to the first urging member 7 and supported at one end by the front cover 2 and at the other end by a blocked end of the front piston 6*b*. When the electromagnet 5 is in a deenergized state, the second elastic body 9 is somewhat compressed between the front cover 2 and the front piston 6*b* because it is smaller in repulsion force than the first urging member 7.

A suction valve and exhaust valve, not shown, are provided in the front cover 2 to open and close a passage between the fluid operation chamber and an outside.

In the aforementioned electromagnetic type reciprocating pump 1, the magnetization and demagnetization of the electromagnet 5 are repeated by, for example, a half wave-rectified pulse of alternating current. In the magnetization mode, the magnetic member 6*a* is attracted, as indicated by the phantom line in FIG. 1, compressing the first urging member 7 and moving the piston 6 to the right of FIG. 1. When this is done, the capacity of the liquid operation chamber 12 and hence of the front cylinder 8 is increased, thus opening the suction valve, not shown, by its negative pressure to such a fluid into the liquid operation chamber 12. At this time, to the piston 6 which is moved under a magnetic action in the forward direction a spring force of the second urging member 9 acts in the same forward direction, assuring the positive operation of the piston 6 even if an input voltage which is applied to the electromagnetic 9 is lowered.

In the demagnetization mode of the electromagnet 5, the piston 6 is moved to the left of FIG. 1 under a reaction force of the first urging member 7 in the backward direction. When this is done, the capacity of the fluid operation chamber 12 is decreased, causing a fluid in the fluid operation chamber 12 to be compressed so that the fluid there is exhausted from the exhaust valve. In the pump 1, even if at this time the fluid which is previously sucked into the fluid operation chamber 12 is not enough to obtain a cushion action relative to the piston 6 due to a low input voltage involved at the time of, for example, starting the pump, the second urging member 9 acts as a cushion or air damper thus never generating a pounding sound due to an impact of the piston 6 upon the front cover 2.

By adjusting an input voltage which is applied to the electromagnet 5, it is possible to control a fluid pressure or amount in the electromagnetic type reciprocating pump.

What is claimed is:

1. An electromagnetic reciprocating gas pump comprising:

an electromagnet whose magnetization and demagnetization are repeated by a half wave-rectified version of alternating current or direct current in the form of pulses;

a piston having a magnetic member which is attracted by magnetization of the electromagnet;

a cylinder in which the piston is inserted and guided along it;

first urging means for imparting a reaction force in backward direction to the piston which is reciprocated by a magnetic force of the electromagnet; and second urging means for imparting to the piston in a forward direction a reaction force which is weaker than that of the first urging means, wherein the piston has a hollow front portion and a hollow rear portion, the cylinder comprises a front cylinder and a rear cylinder, the front cylinder has a variable volume closed air-operating chamber formed therein, the hollow front portion of the piston has an opening to the air-operating chamber, the rear cylinder has an air passage communicating with the atmosphere, the hollow rear portion of the piston has an opening to the air passage, the magnetic member comprises a magnetic armature interposed between the hollow front and rear portions of the piston, the first urging means comprises a first compression spring for moving the piston in the backward direction when the magnetic force of the electromagnet for attracting the magnetic armature is reduced, and support means having a screw projecting to the rear cylinder for supporting the first compression spring and adapted to be moved by the screw in the forward and backward directions, said first compression spring having a spring constant thereof adjusted by the support means, and the second urging means comprises a second compression spring fitting in the hollow front portion of the piston and having a spring constant thereof smaller than that of the first compression spring, said second compression spring having an outer diameter substantially equal to the inner diameter of said hollow front portion, the second compression spring having a length such that both ends of the spring are continuously supported between and by a bottom surface of said front cylinder and a bottom surface of said hollow front portion of said piston, respectively, to thereby form an air damper in said air operating chamber to prevent said hollow front portion of said piston from impacting against said front cylinder.

* * * * *